US005381118A

United States Patent [19]

Baclaine et al.

[11] Patent Number: 5,381,118

[45] Date of Patent: Jan. 10, 1995

[54] DUAL-MODE CAVITY FILTER HAVING INPUT AND OUTPUT COUPLING IRISES

[75] Inventors: Patrick Baclaine, Le Vesinet; Jean-Louis Lambert, Nanterre, both of France

[73] Assignee: Alcatel Telspace, Nanterre Cedex, France

[21] Appl. No.: 139,836

[22] Filed: Oct. 22, 1993

[30] Foreign Application Priority Data

Oct. 22, 1992 [FR] France ..... 92 12650

[51] Int. Cl.[6] ..... H01P 1/208

[52] U.S. Cl. ..... 333/209; 333/212

[58] Field of Search ..... 333/202, 208, 212, 227, 333/230, 222–226

[56] References Cited

U.S. PATENT DOCUMENTS

| | | | |
|---|---|---|---|
| 3,070,873 | 1/1963 | Gordon | 29/600 |
| 3,936,775 | 2/1976 | Snyder | 333/212 |
| 4,396,896 | 8/1983 | Williams | 333/208 X |
| 4,630,009 | 12/1986 | Tang | 333/212 X |

FOREIGN PATENT DOCUMENTS

| | | |
|---|---|---|
| 325320 | 12/1957 | Switzerland . |
| 8704013 | 7/1987 | WIPO . |

OTHER PUBLICATIONS

Microwave Systems News, vol. 6, No. 4, Sep.1976, Palo Alto, US, pp. 75–77, A. E. Atia et al. "Waveguide filters for space, smaller, lighter and fewer cavities".

1990 IEEE MTT-S International Microwave Symposium-Digest, vol. 1, May 8–10, 1990, Dallas, US; IEEE, New York, US, 1990, U. Rosenberg: "A new multiplexing principle".

*Primary Examiner*—Seungsook Ham

*Attorney, Agent, or Firm*—Sughrue, Mion, Zinn, Macpeak & Seas

[57] ABSTRACT

Agile microwave filter having at least two two-mode cavities with parallel axes and coupled by an iris. The input and output ports are irises in the back plate of the filter. The frequency response of the filter is therefore symmetrical. The plate and therefore the irises are interchangeable to increase the agility of the filter.

2 Claims, 2 Drawing Sheets

DUAL-MODE CAVITY FILTER HAVING INPUT AND OUTPUT COUPLING IRISES

BACKGROUND OF THE INVENTION

1. Field of the Invention

The present invention concerns an agile microwave bandpass filter having two-mode cavities that are parallel coupled, i.e. coupled through iris and screws, as opposed to line-structured filters.

2. Description of the Prior Art

There are two types of prior art agile microwave filters using parallel coupled cylindrical cavities, i.e. cylindrical cavities with parallel axes coupled together via an iris:

Single-mode cavity filters having the drawbacks of being relatively bulky, relatively costly and relatively long time to set up, because of the plurality of cavities.

Two-mode cavity agile filters in which two coupled orthogonal modes are generated in each cavity and which represent an improvement over the first type from the cost and setting up time points of view.

The accompanying FIGS. 1 and 2 are respectively views in perspective and diagrammatic transverse cross-section of a prior art four-pole agile filter which has two two-mode cavities of the TE11n type.

This filter thus comprises two cylindrical resonant cavities 1, 2 which are identical and which have parallel axes.

The internal volume of these cavities is adjustable by means of mobile pistons 3, 4 which enable adjustment of the resonant frequency of each of the cavities so that the tuning frequency of the filter can be shifted, i.e. to provide the required frequency agility of the filter.

As can be seen more clearly in FIG. 2, the filter input cavity 1 is fed by a rectangular waveguide 5 coupled to the cavity 1 by a coupling iris 6.

The cavity 1 thus resonates in the TE11n mode, for example, and provides the orientation of the electric field vector E1.

A 45° coupling screw 7 enables another mode to be generated in the cavity 1, through disturbance of this cavity, at the same frequency but with an electric field vector E2 orthogonal to the first. A tuning screw 8 is used to adjust precisely the volume of the cavity 1 in order to compensate for the small disturbance in particular due to the coupling screw 7 and of the input iris 6.

Finally, the cavity 1 resonates in two TE11n modes, whence the name two-mode cavity.

The cavity 1 is coupled to the other cavity 2 by a coupling iris 19. By coupling of the magnetic field the latter allows the cavity 2 to resonate at the same frequency as the cavity 1, in a mode T11n with electric field E3.

As previously, a 45° coupling screw 9 generates in the cavity 2 a second mode with electric field E4 orthogonal to the electric field E3. The mode E4 is magnetically coupled to the output waveguide 10 by a coupling iris 11. A tuning screw 18 is provided as previously.

The end result is a four-pole agile bandpass filter using only two "parallel" coupled cavities 1, 2, i.e. with a coupling parallel to the axis of cavities 1 and 2.

Of course, a six-pole agile bandpass filter may be obtained in the same manner by using three two-mode cylindrical cavities with parallel coupling, or more generally, an agile bandpass filter with 2 n poles (where n is an integer) may be obtained using n parallel two-mode cavities each coupled to the next by an iris, in the manner that the cavities 1 and 2 are coupled as shown in the drawing.

The above two-mode cavity agile filters have the following advantages:

- they are simple to control, because of the double resonance per cavity, which greatly simplifies the mechanical construction of the filter;
- the total travel of the adjuster pistons 3, 4 is relatively long (around 10 mm), and enables a great accuracy in the frequency tuning with frequency agility.

However, they have the major disadvantage of an asymmetric frequency response resulting of the disturbances brought by the input and output irises, which is not the case with single-mode cavity filters.

The invention is directed to remedying these disadvantages.

SUMMARY OF THE INVENTION

The invention consists in an agile microwave bandpass filter having a plurality of parallel-coupled cylindrical two-mode cavities of adjustable volume that have parallel axes, one of the cavities being coupled to the other via an iris, in which to obtain a symmetrical frequency response its input port and output port are respectively on the back of the cylindrical input cavity and on the back of the cylindrical output cavity rather than on the side of each cavity as in the conventional arrangement.

Advantageously said ports are formed by respective input and output irises on an interchangeable back plate whereby the center frequency of the filter may be varied over a wider range by means of a set of plates and thus of input/output irises.

The invention will be better understood and its advantages and other features will emerge from the following description of one non-limiting example of the invention given with reference to the appended diagrammatic drawings.

DETAILED DESCRIPTION OF THE INVENTION

Figure 1:
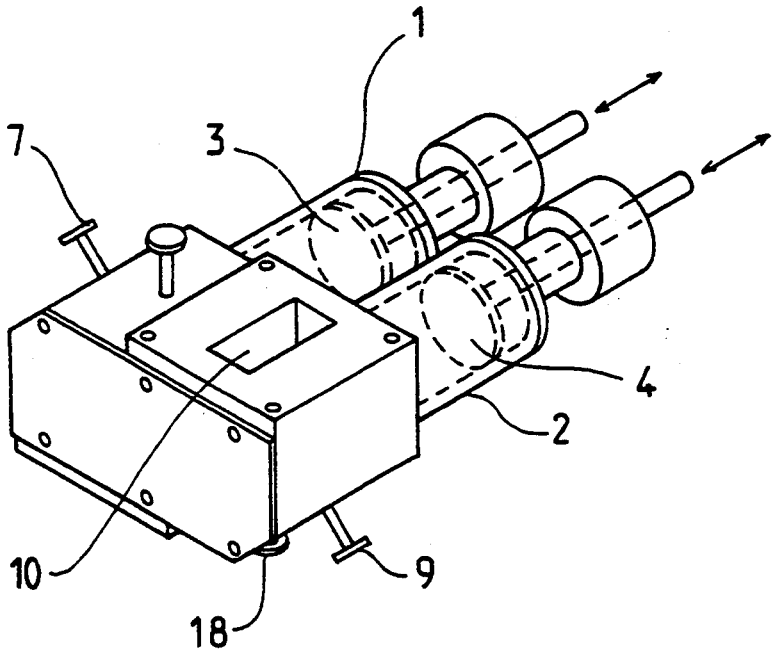
FIG.1 PRIOR ART
FIGS. 1 and 2 are respectively a perspective view and a view in transverse cross-section of a prior art two-mode cavity agile filter.
Figure 2:
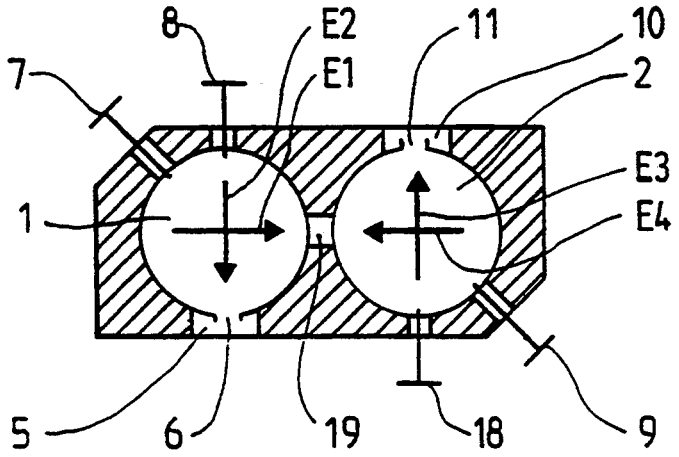
FIG.2 PRIOR ART
Figure 3:
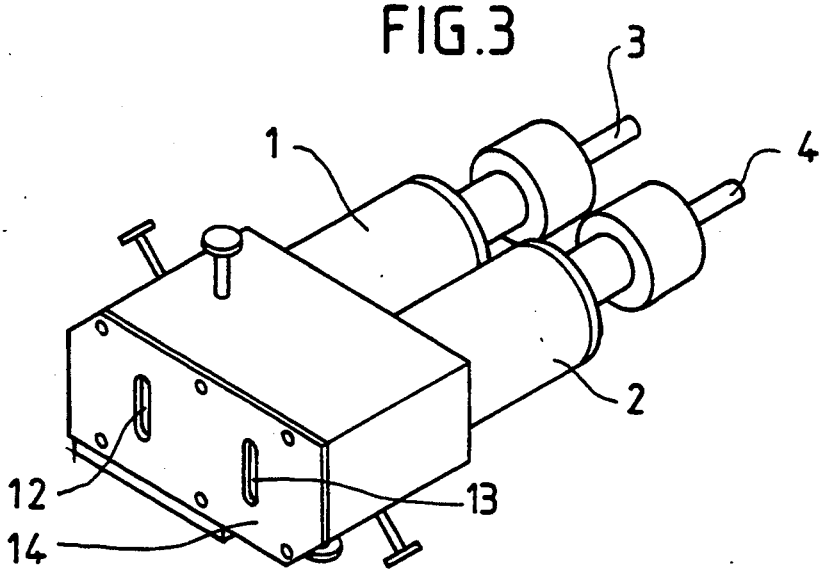
FIG. 3 is a perspective view similar to FIG. 1 showing a two-mode cavity in accordance with the invention.
Figure 5:
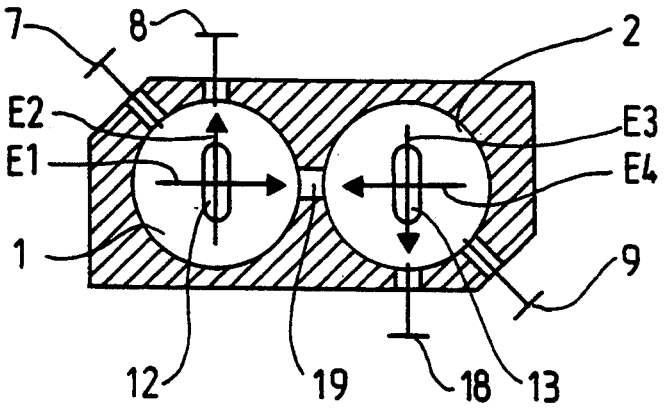
FIG. 5 is a top view in transverse cross-section of the filter from FIG. 3 similar to the view in FIG. 2.

Referring to FIGS. 3 and 5, this microwave agile bandpass filter differs from that shown in FIGS. 1 and 2 in that its input and output ports are no longer on the side of the input cavity 1 and the output cavity 2, respectively, but are provided by respective coupling irises 12 and 13 formed for this purpose in the back plate 14 of the filter, this plate being common to the cavities 1 and 2. In other words, the input and output ports are respectively through the back of the input cavity 1 and the back of the output cavity 2.

As the back plate 14 is screwed on it is readily replacable and a set of plates 14 is provided comprising different size irises 12, 13 so that the center frequency of the agile filter can be moved over a much wider range than is possible merely by displacement of the adjuster pistons 3 and 4.

An agile bandpass filter as shown in FIG. 3 has been made by the applicant with irises 12, 13 of a particular size, a frequency agility covering a bandwidth of 150 MHz and a symmetrical frequency response, for example. By changing the size of the irises 12, 13 the same filter acquired an agility covering a total bandwidth of 650 MHz.

Figure 4:
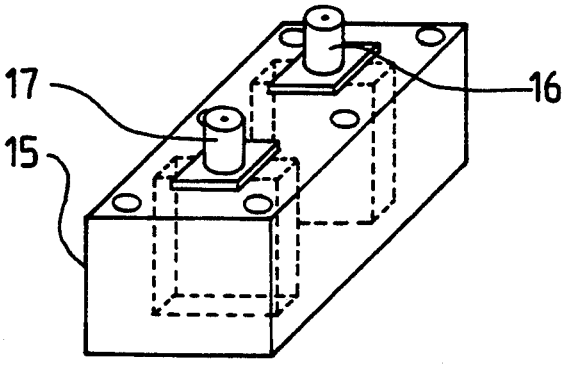
FIG. 4 is a perspective view to a larger scale of a coaxial/guide and guide/coaxial transition which may be attached to the back plate of the filter of FIG. 3.

FIG. 4 shows a coaxial/guide and guide/coaxial transition 15 which has no special features in itself and which may advantageously be screwed to the plate 14 to provide an input and an output via coaxial cables. The filter input is then via an input coaxial plug 16 and the output via an output coaxial plug 17.

Obviously the invention is not limited to the embodiments that have just been described. Specifically it encompasses a bandpass filter having more than two cavities and therefore more than four poles.

There is claimed:

1. An agile microwave bandpass filter having an input port and an output port and having a plurality of parallel-coupled cylindrical two-mode cavities of adjustable volume that have parallel axes, each cavity having an end face perpendicular to the cylindrical cavity axis at one end of said cavity, one of the cavities being coupled to the other via an iris, said input port of said filter being located in said end face of one of said cylindrical cavities and said output port of said filter being located in said end face of another of said cylindrical cavities, to thereby obtain a symmetrical frequency response.

2. An agile filter according to claim 1, wherein said filter includes a removable back plate forming said end faces of each of said one and another cavities, said input port being formed by an input iris in said back plate and said output port being formed by an output iris in said back plate, whereby replacing said back plate with a new back plate having different input and output irises will vary the center frequency of said filter.

* * * * *